US008939003B2

(12) United States Patent
Schlatter et al.

(10) Patent No.: US 8,939,003 B2
(45) Date of Patent: Jan. 27, 2015

(54) METHOD AND DEVICE FOR THE PRODUCTION OF A STAMPING WITH ALMOST SMOOTH CUTTING AND ENLARGED FUNCTIONAL SURFACE

(75) Inventors: Ulrich Schlatter, Lyss (CH); Pavel Hora, Mellingen (CH)

(73) Assignee: Feintool Intellectual Property AG, Lyss (CH)

( * ) Notice: Subject to any disclaimer, the term of this patent is extended or adjusted under 35 U.S.C. 154(b) by 876 days.

(21) Appl. No.: 12/286,008

(22) Filed: Sep. 26, 2008

(65) Prior Publication Data

US 2009/0165525 A1 Jul. 2, 2009

(30) Foreign Application Priority Data

Sep. 26, 2007 (EP) ..... 07018892

(51) Int. Cl.
*B21D 28/16* (2006.01)

(52) U.S. Cl.
CPC ..... *B21D 28/16* (2013.01)
USPC ..... 72/332

(58) Field of Classification Search
USPC ..... 72/326–339, 344, 350, 379.2; 83/40, 55
See application file for complete search history.

(56) References Cited

U.S. PATENT DOCUMENTS 3,554,065 A * 1/1971 Kunz ..... 83/55
3,776,016 A * 12/1973 Quinn et al. ..... 72/327
4,586,360 A * 5/1986 Jurgensmeyer et al. ..... 72/328
6,125,527 A * 10/2000 Sunaga et al. ..... 72/334
6,370,931 B2 * 4/2002 Bennett ..... 72/336

FOREIGN PATENT DOCUMENTS

| | | |
|---|---|---|
| CH | 665367 | 5/1988 |
| DE | 2127495 | 12/1971 |
| DE | 19738636 | 3/1999 |
| EP | 1815922 | 8/2007 |
| JP | 2004-283875 | 10/2004 |

OTHER PUBLICATIONS

Anonymous: "Feinstanzen, Ein Rationelles Fertigungsverfahren", Announcement Feinstanz AG, Feinstanz, Ch, Juni 1962, pp. 37-40, XP001335150.
K. Kondo, "Das Stauchschneiden-ein neues Schneidverfahren fuer genaue Werkstuecke mit glatten Schnittflaechen", Industrie Anzeiger, Annual vol. 39, Nr. 33, pp. 547-550.

* cited by examiner

*Primary Examiner* — Teresa M Ekiert
(74) *Attorney, Agent, or Firm* — Jordan and Hamburg LLP

(57) ABSTRACT

A method and device for production of stampings with an almost smooth cutting and enlarged functional surface, especially fine blanking and/or forming a workpiece out of a flat strip, wherein flat strip is clamped between an upper part consisting of a shearing punch, a pressure pad, a V-shaped projection and an ejector arranged on the pressure pad, and a lower part consisting of cutting die, ejector and an inner form stamp. By adjusting the state of stress in the cutting zone to a position oriented compressive stress by movement slightly retarded with regard to movement of the shearing punch additionally pressing in material in a direction almost perpendicular to the cutting direction by a tool element acting with controlled force depending on the part geometry and thickness of the workpiece parallel to the cutting line between shearing punch and cutting die, tears at cutting and reduced rollover are achieved.

26 Claims, 6 Drawing Sheets

State of the Art

FIG. 2 (State of the Art)

METHOD AND DEVICE FOR THE PRODUCTION OF A STAMPING WITH ALMOST SMOOTH CUTTING AND ENLARGED FUNCTIONAL SURFACE

BACKGROUND OF THE INVENTION

The invention relates to a method for the production of stampings with an almost smooth cutting and enlarged functional surface, especially fine blanking and/or forming a workpiece out of a flat strip, wherein the flat strip at closing is clamped between an upper part consisting of a shearing punch, a pressure pad for the shearing punch, a V-shaped projection arranged on the pressure pad, and an ejector and a lower part consisting of a cutting die, an ejector and an inner form stamp, and in the cutting zone a cut is enforced by shearing at high compressive stress, wherein the V-shaped projection has been pressed into the flat strip beforehand and a compressive stress acts on the flat strip to be cut.

The invention further relates to a device for the production of stampings with an almost smooth and enlarged functional surface, especially fine blanking and/or forming a workpiece out of a flat strip, with a tool having two parts comprising at least a main shearing punch, a pressure pad for the shearing punch, a V-shaped projection arranged on the pressure pad, an ejector, and a cutting die, wherein the flat strip is clamped between pressure pad and cutting die and the V-shaped projection is pressed into the flat strip.

It is known that fine blanking at projecting contours of parts, for example toothings or corners, often leads to tears at the cutting surfaces. This phenomenon can be observed in even greater intensity the sharper an outer contour is defined, the thicker the material to be cut and the smaller is the ductility of the material. In most of the cases in fine blanking, the cutting surface acts as functional surface, wherefore tears can be the point of origin of a breaking failure of the part under load and therefore have to be avoided.

Smooth cutting surfaces at fine blanking are achieved, when in the cutting zone, by superposition of high hydrostatic pressure is enforced, a cut by shearing, i.e. a plastic deformation. The cutting surface occurs in the shearing zone, and thus, with regard to its quality, is influenced by the material properties (K. KONDO, Industrie-Anzeiger, annual volume 39, nr. 33, p. 547 to 550). At fine blanking, the V-shaped projection, before the cutting starts, is pressed into the material of the flat strip to be cut, and thus prevents continuous flow of the material during the cutting process.

Furthermore, typical features of fine blanking parts are the edge rollover and the cutting burr. Especially in corner areas, the rollover occurs and grows with decreasing corner radius and increasing sheet thickness. The depth of the rollover can be about 30% and the width of the rollover about 40% of the sheet thickness or more (see DIN 3345, Feinschneiden, Aug. 1980). Thus, the rollover depends on material thickness and quality, so that the possibility to control it is limited and often brings about a limited functionality of parts, for example due to a lack of sharp edges of the corners at toothed parts or the caused change in the functional length of the parts.

The stamping rollover thus reduces the functionality of parts and urges the manufacturer to use a thicker raw material.

A number of solutions are known for trying to produce fine and smooth shearing surfaces by cutting under pressure (DE 2 127 495 A1), re-cutting (CH 665 367 A5), shaving (DE 197 38 636 A1) or shifting of material during the cutting (EP 1 815 922 A1).

The known solutions according to CH 665 367 A5 and DE 197 38 636 A1 do not reduce the edge rollover, but largely rework the parts, so that on the one hand, significant costs for additional machining operations and tools are required and, on the other hand, a respective loss of material due to the necessity of using thicker materials occurs.

The known shearing press according to DE 2 127 495 A1 is operated at a higher hydrostatic pressure acting on the whole area of the workpiece subjected to plastic deformation. This high pressure, especially near the edges of the tool, is created by an upper jaw having a projection. This projection, so to speak, carries out the function of the V-shaped projection not existing according to DE 2 127 495 A1. But with this known method, in the first instance, the projecting stamping burr is avoided. Also with this known solution the rollover lastly is not avoided and material volume is shifted along the cutting line, which is accompanied by an increased risk of developing tears.

In the known solution according to EP 1 815 922 A1, the workpiece is machined in a single-step setup in at least two chronologically successive steps in different cutting directions, wherein during a first cutting process in vertical working direction is cut out a semi-finished product corresponding to the geometry of the workpiece with small rollover and finally cut during at least one further cutting process in the opposite working direction. The rollover of the first partial step with this shall be filled up again at least in the corner area. But with this known method, in the first instance, the projecting stamping burr is avoided. Also with this known solution, the rollover lastly is not avoided and material volume is shifted along the cutting line, which is accompanied by an increased risk of developing tears.

At this state of the art the invention has the task to avoid the inclination to tearing at cutting surfaces and the edge rollover at fine blanking parts by systematically controlling the state of stress in the cutting zone and at the same time to economically and effectively realize the fine blanking of thicker parts with high process security.

SUMMARY OF THE INVENTION

This task is solved by a method of the above mentioned kind which includes clamping a flat strip at closing between an upper part including a shearing punch, a guide plate for the shearing punch, a V-shaped projection arranged on the guide plate and an ejector, and a lower part including a cutting die, an ejector and an inner form stamp. A cut is enforced in a cutting zone by shearing at high compressive stress, wherein the V-shaped projection has been pressed into the flat strip beforehand and a compressive stress acts on the flat strip to be cut. The method further includes adjusting a state of stress in the cutting zone to a position oriented compressive stress from the beginning of the cutting process to an end thereof by a movement slightly retarded with regard to the movement of the shearing punch additionally pressing in material in a direction almost perpendicular to the cutting direction by operation of a tool element acting with controlled force depending on a part geometry and a thickness of the workpiece parallel to the cutting line between the shearing punch and cutting die.

In accordance with the invention, it is possible for the first time to economically apply the fine blanking technique for parts, for example toothed parts of greater thickness, without tears, and resultant sharp edges without finishing and material shifting along the cutting line.

This is achieved by adjusting the state of stress in the cutting zone to a position oriented compressive stress from the beginning of the cutting process to its end by a movement slightly retarded with regard to the movement of the shearing punch additionally pressing in material in a direction almost perpendicular to the cutting direction by means of a tool element acting with controlled force depending on the part geometry and the thickness of the workpiece parallel to the cutting line between shearing punch and cutting die.

It is of special advantage that the parameters for controlling the state of stress in the cutting zone, for example the volume of material to be additionally pressed in depending on the type of material, shape and geometry of the workpiece can be determined by a virtual forming simulation according to the results of which are then designed the tool elements for pressing additional material in the direction of the cutting zone.

It is of significant importance that with the method according to this invention it is possible to press additional material into the cutting zone in transversal direction, thereby significantly reducing the edge rollover at the part. By maintaining the state of stress in the cutting zone in the area where the pressure is applied, it is guaranteed that the cutting surfaces are smooth and free of tears. Further, the functional surfaces, because of the reduced edge rollover, are almost free of rollover.

Thus, the method according to this invention in high quality covers fine blanking in a wide range of dimensions, for example parts up to great thicknesses and complex part geometries, as for instance toothings of driving gears. Furthermore, with the method according to this invention it is also possible to fine blank lower steel qualities without running the risk of developing tears at the cutting surfaces.

The device according to this invention has a simple and sturdy structure.

Further advantages and details accrue from the following description with reference to the attached figures.

The invention in the following will be explained in more detail at the example of two embodiments.

DETAILED DESCRIPTION OF THE INVENTION

Figure 1:
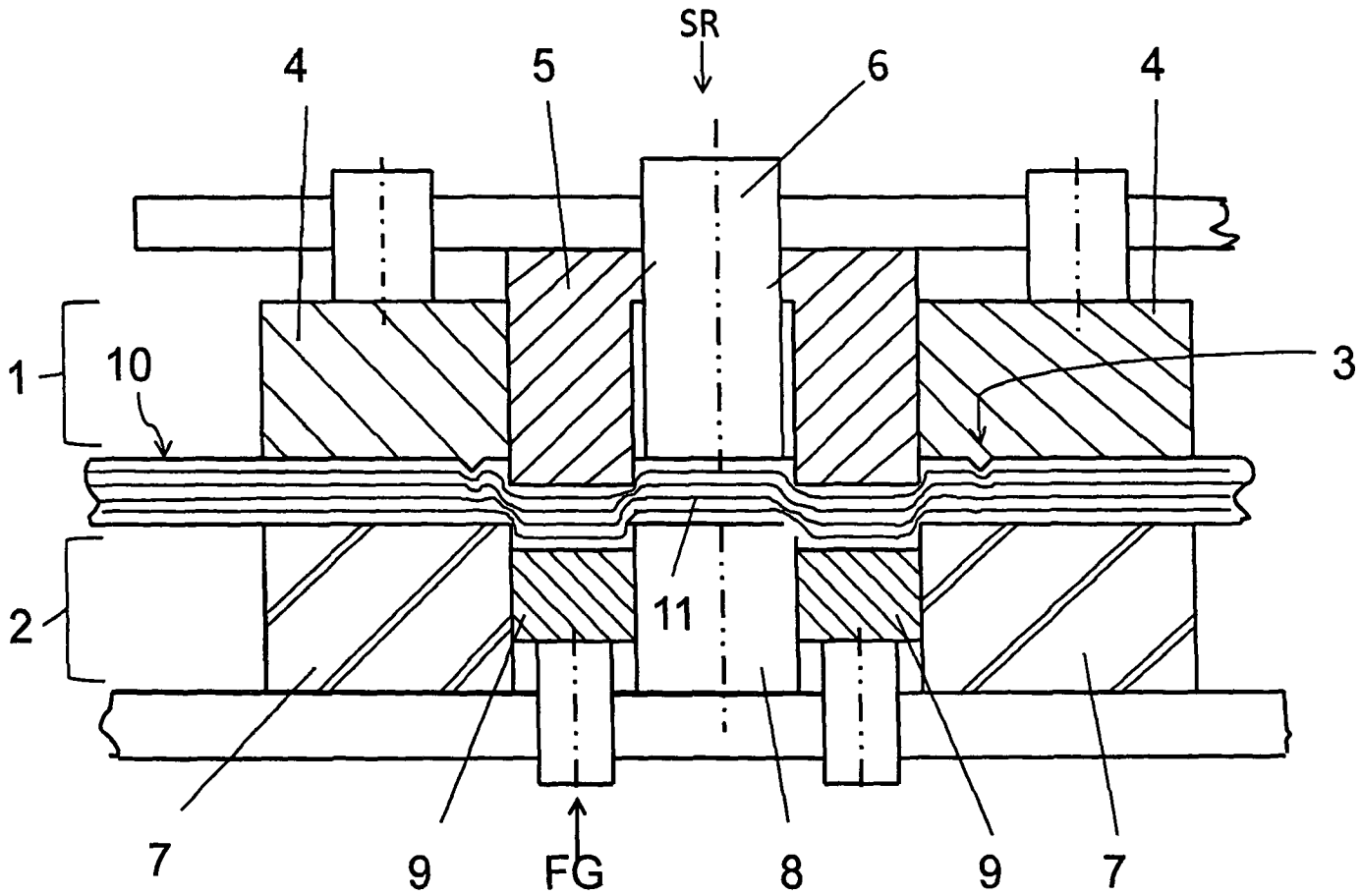
FIG. 1 is a schematic section of the principal structure of a fine blanking tool according to the state of the art.

FIG. 1 shows the principal structure of a fine blanking tool according to the state of the art in the closed state.

The fine blanking tool has an upper part 1 and a lower part 2. The upper part 1 consists of a guide plate 4 with a V-shaped projection 3, a shearing punch 5 guided in the guide plate 4 and an ejector 6. The lower part 2 consists of a cutting die 7, an inner form or hollow punch 8 and an ejector 9. The flat strip 10 of alloyed stainless steel with a thickness of 12 mm, out of which, according to the method of this invention, shall be fabricated a fine blanking part 11, for example a connecting flange made of a steel strip, which, according to the state of the tool, is clamped between pressure pad 4 and cutting die 7. The V-shaped projection 3 has already penetrated the flat strip 10, whereby due to the applied force of the V-shaped projection the material is prevented from continue flow during cutting. The cutting die 7 and the inner form fall have cut about half the thickness of the fine blanking part 11.

Figure 2:
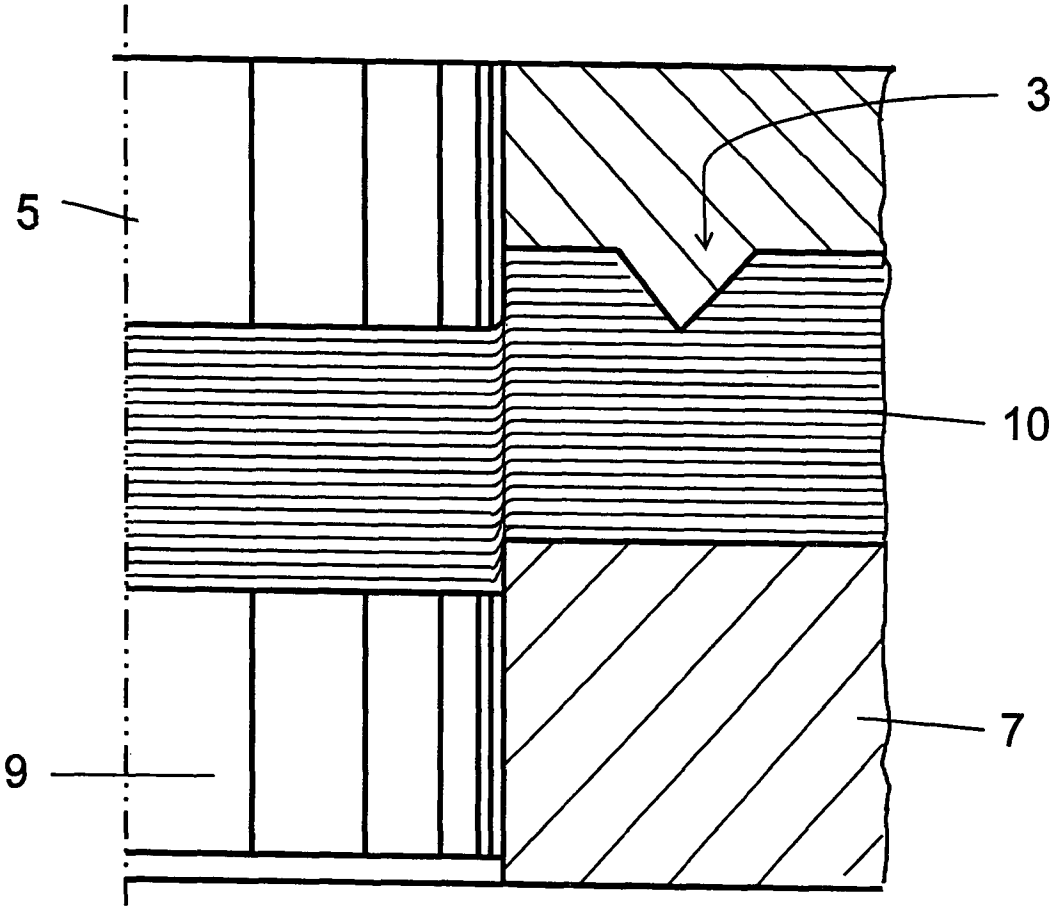
FIG. 2 depicts the cutting zone according to FIG. 1, in detail.

In FIG. 2 the cutting zone according to the state of the art according to FIG. 1 is shown in detail. The flat strip 10 lies between cutting die 7 and guide plate 4. The V-shaped projection 3 with the force of the V-shaped projection FR presses the flat strip 10 on the cutting die 7. The shearing punch 5 with its shearing force FS works against the opposing force FG created by the pressure pad, in this case ejector 9. The shearing force FS depends on the inner and outer lengths of the cutting line of the part, the thickness, the tensile strength of the material to be cut and an influence factor taking into account the yield strength-tensile strength-ratio workpiece material, the geometric shape of the cutting part, the lubrication of the tool and the bluntness of the shearing punch 5 and the cutting die 7.

In the clamped state of the flat strip 10 between cutting die 7 and pressure pad 4 with V-shaped projection 3 in the beginning of the cutting in the cutting zone a state of stress occurs characterized by a high compression stress. The deeper the shearing punch during cutting penetrates into the material, the greater the reduction of the state of compression stress in the cutting zone, so that at the end of the cutting operation, the compression stress changes into a tensile stress. This is the reason for the development of tears, especially at parts with complex geometry, for example toothings or corners, and greater thickness (R. A. Schmidt, "Umformen und Feinschneiden", Carl Hanser Verlag München Wien, 2007).

Embodiment 1

Figure 3:
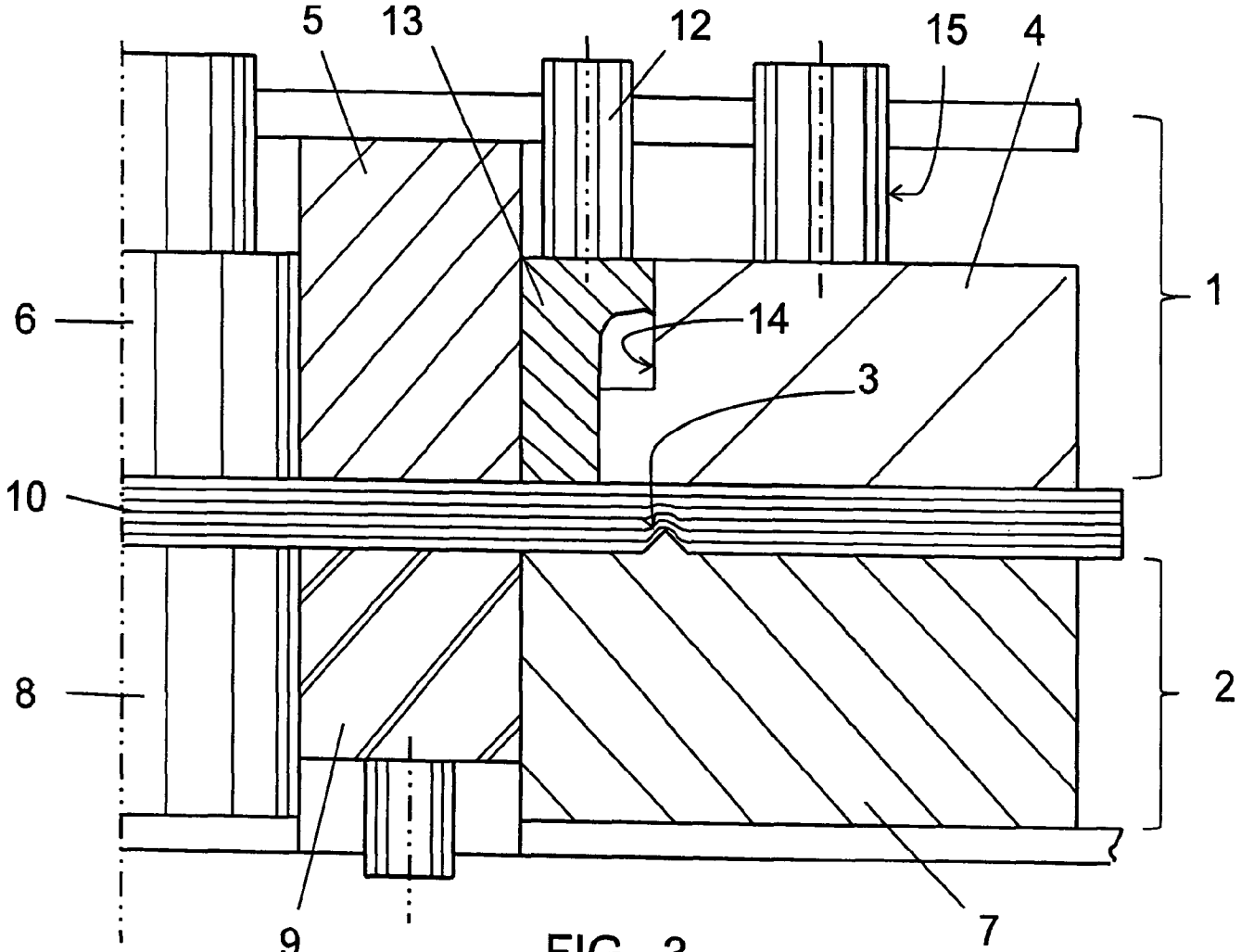
FIG. 3 is a section through the device according to this invention without the free punch in the flat strip in the clamped state according to the method of this invention.

The device according to this invention in embodiment 1 substantially corresponds to the structure of the device described according to FIG. 1, but with the difference, that a V-shaped projection 3 is arranged on cutting die 7. Instead of the previously allocated to guide plate 4, V-shaped projection is provided an active tool element 13, which can be applied and operated via a hydraulic stud 12, that acts with the respective force FW in the direction of the cutting line SL on the flat strip 10 (see, for example, FIG. 3). The tool element 13 on one side is supported by shearing punch 5 and on the other side by a recess formed into guide plate 4, and is vertically moveable with regard to the flat strip. In FIG. 3 the flat strip 10 does not have a free punch and the active tool element 13 is not yet engaged. The flat strip 10 in clamped state lies between upper and lower parts of the device according to this invention. The lower V-shaped projection 3 has penetrated the flat strip 10 and the pressure pad 4 with the respective force FF created by stud 15 presses on the flat strip 10.

Figure 4:
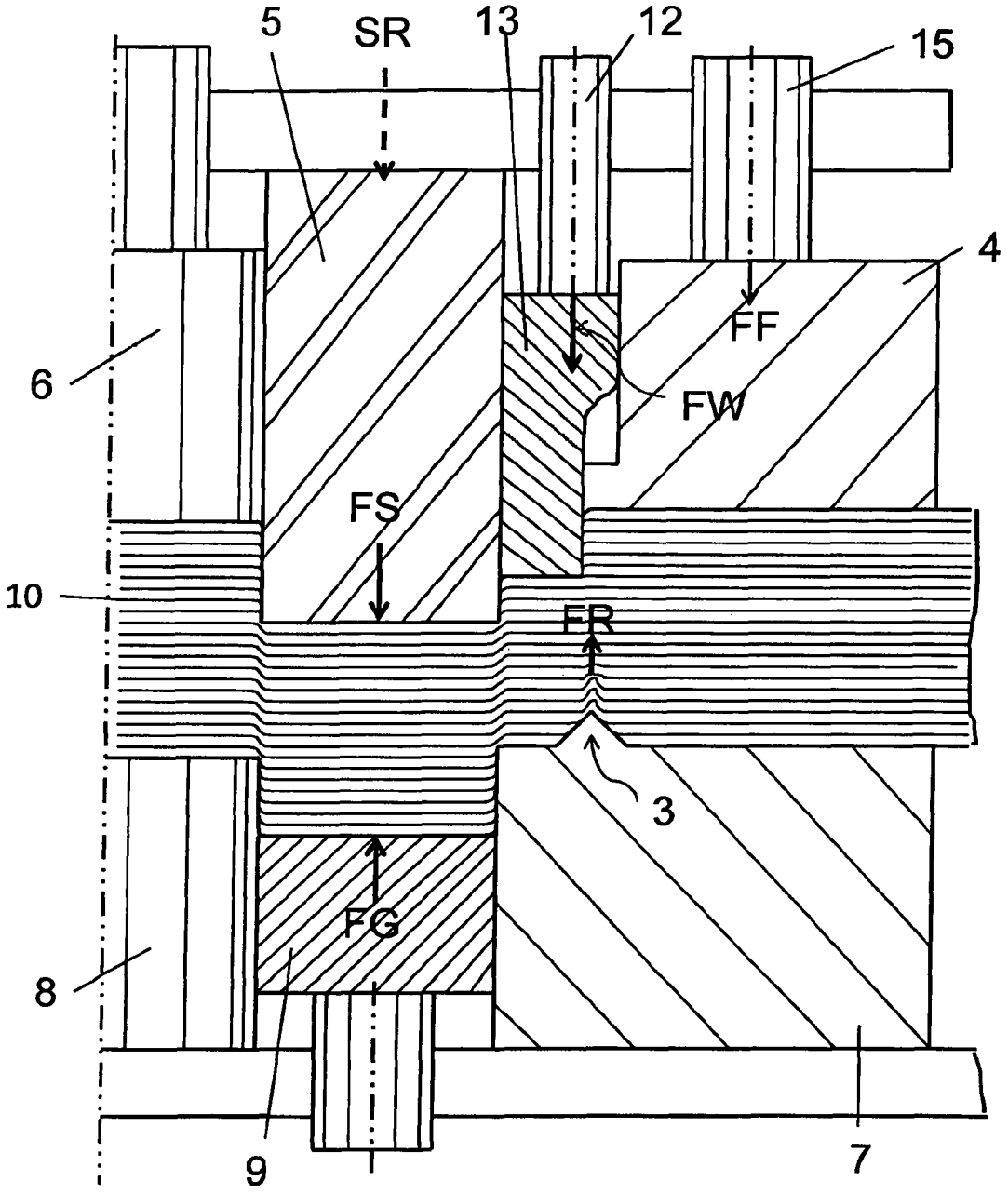
FIG. 4 is a section through the device according to this invention without the free punch in the flat strip in the half-cut state according to the method of this invention.

According to FIG. 4 the shearing punch 5 has nearly half-cut the flat strip 10. Also the active tool element 13 has moved into the material of the clamped flat strip 10, wherein the movement of the active tool element 13 with regard to the movement of the shearing punch 5 is slightly retarded.

Figure 5:
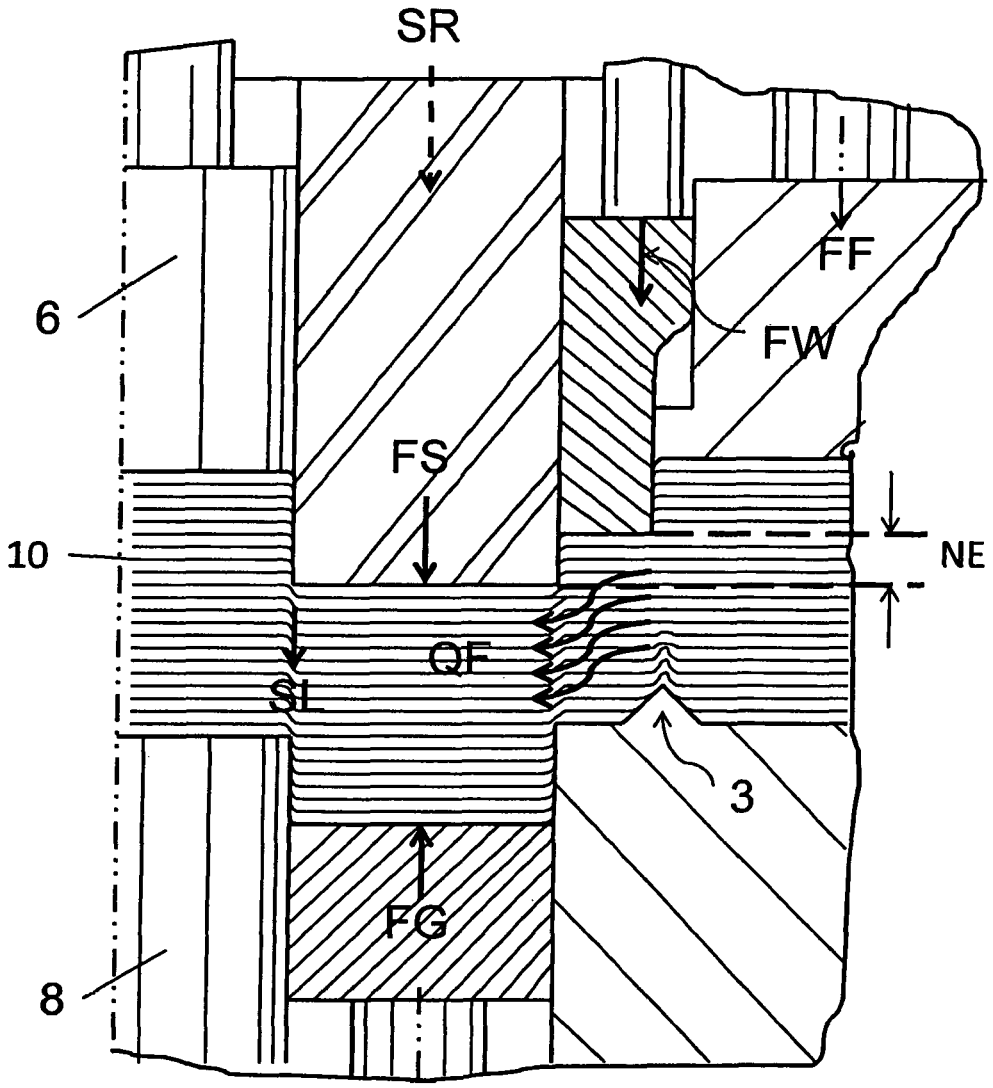
FIG. 5 depicts the cutting zone according to FIG. 4, in detail.

FIG. 5 illustrates how the material is shifted quasi-perpendicular into the cutting zone due to the penetration of the active tool element 13 into the flat strip 10 in cooperation with the lower V-shaped projection 3. Due to this, the state of stress in the cutting zone always corresponds to a compression stress, which depending on the type of material, shape and geometry of the workpiece can be respectively adjusted by controlling the tool element 13.

The process parameters of the tool element 13, for example the force FW to be applied, the hydraulic pressure for creating the force FW or the value NE by which the movement is retarded with respect to the shearing punch 5, depending on type of material, shape and geometry of the workpiece are determined in a virtual forming simulation, wherein the material flow in the forming process is shown, extensions and reference stress values are analyzed to find out whether the forming can be realized and the tool elements can bear the loads. But the process parameters for determining the force FW of the active tool element 13 can be also determined at the real fine blanking part by individually measuring it. That requires a series of tests and analysis thereof to be able to respectively design the active tool element 13.

As the active tool element 13 can be used as a differential coining stamp penetrating into the workpiece with the coining side to control the state of stress, that is actively connected with a controllable hydraulic mechanism. But it is just as well possible to provide the shearing punch 5 with a shoulder or step to achieve the transversal shift of the material.

The method according to this invention is executed, so that at first, the flat strip 10 is clamped between upper and lower parts 1, respectively 2. From the beginning until the end of the cutting operation with the stud 12 and the active tool element 13 directed pressure is exerted in the area of the cutting zone by means of a controlled hydraulic mechanism. Due to this, a respective state of stress is created in the cutting zone, that during the whole cutting process, acts as compression stress.

This leads to an enhanced surface quality, especially also in the case of poor quality of the material. With the directed coining by means of the active tool element 13 a superposition of the cutting process with a transversal flow QF of part material into the cutting zone is achieved, whereby at the same time also, the stamp rollover in this area is significantly reduced. The lower V-shaped projection 3 supports the transversal flow QF of the material into the cutting zone.

Embodiment 2

Figure 6:
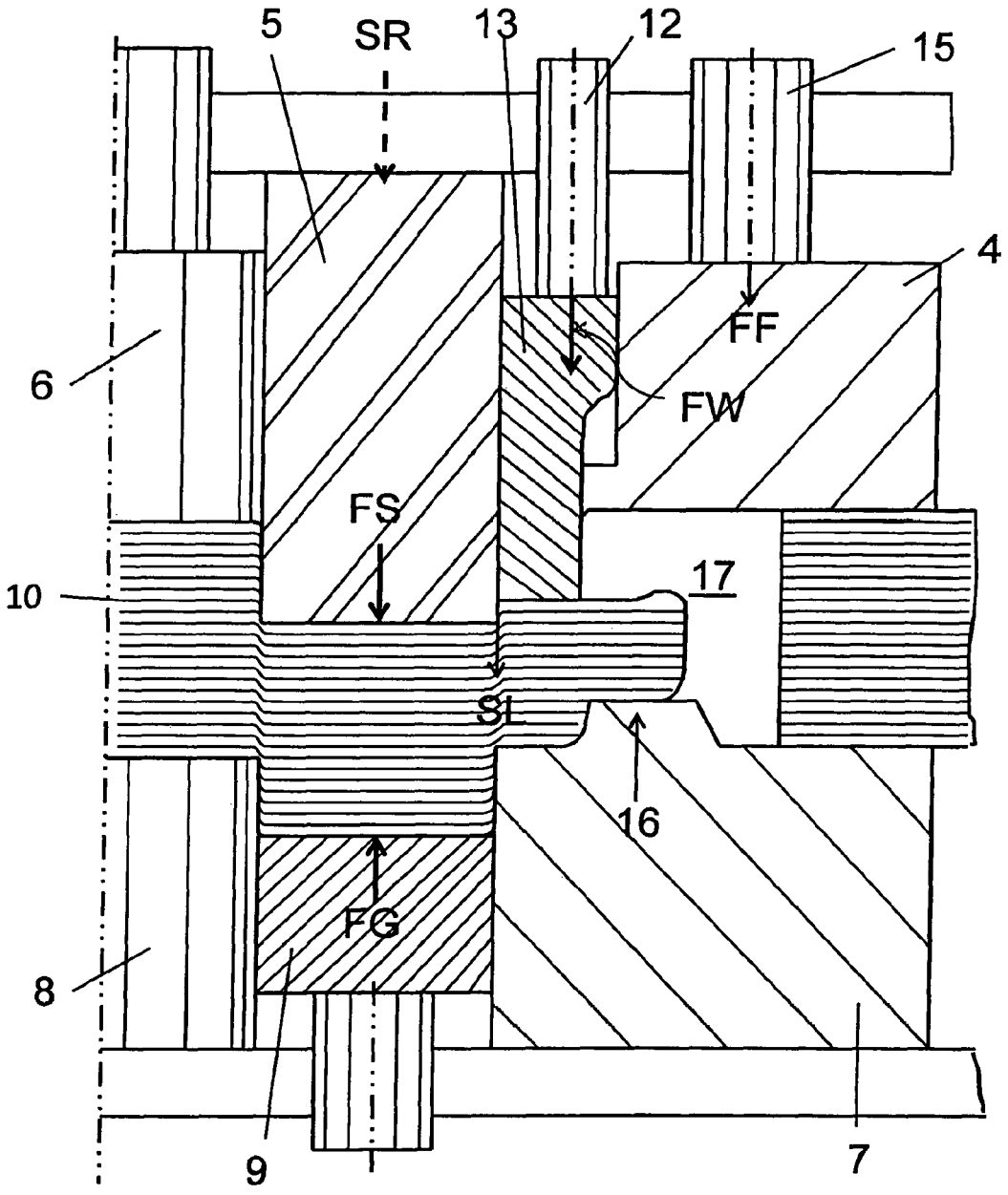
FIG. 6 is a section through the device according to this invention with the free punch in the flat strip in the half-cut state.

FIG. 6 shows a further aspect of the device according to this invention, the basic structure of which corresponds with the structure of the device described in FIG. 3.

Instead of the V-shaped projection 3 being arranged on the cutting die 7 as in embodiment 1, a supporting platform 16 is arranged on the cutting die 7 in embodiment 2 and comes to lie in the free punch 17. The supporting platform 16 prevents the material from flowing into breadth. All other processes correspond with those of embodiment 1.

The invention claimed is:

1. A method for producing stampings out of a flat strip with an almost smooth and enlarged functional surface by fine blanking and forming, comprising:

clamping the flat strip at closing between an upper part and a lower part, the upper part including a shearing punch, a tool element that operates parallel to a cutting line, a guide plate for the shearing punch, and an ejector, the lower part including a cutting die having a projection thereon, an ejector and an inner form stamp;

performing a cut in a cutting zone by first applying a position oriented compressive stress on the cutting zone between said upper and lower part, then shearing through at a high compressive stress with the shearing punch and cutting die to complete the cut; and during said applying the position oriented compressive stress and the shearing at high compressive stress, the tool element acting with a controlled force in opposition to a squeezing of material by the cutting die to resqueeze the material in the cutting zone in a direction diagonal to the cutting line between the shearing punch and the cutting die; and wherein an additional shearing punch is employed as the tool element for controlling said force during said acting.

2. A method according to claim 1, wherein said stampings include fine blanking and/or forming a workpiece out of the flat strip.

3. A method according to claim 1, wherein parameters for adjusting a state of stress in the cutting zone are determined by a virtual forming simulation.

4. A method according to claim 3, wherein said parameters include a volume of material to be additionally pressed in depending on a type of material, shape and geometry of a workpiece formed out of the flat strip.

5. A method according to claim 2 or 4, wherein said inner form stamp comprises a differential coining stamp having a coining side which penetrates into the workpiece.

6. A method according to claim 1 or 3, wherein the compression stress in the flat strip to be cut is created by cooperation of said projection and the tool element.

7. A method according to claim 1 or 3, wherein said applying position oriented compressive stress on the cutting zone is realized at parts having teeth or corner areas of medium to relatively greater thickness.

8. A method according to claim 1, wherein said projection is a V-shaped projection arranged on the cutting die, and said V-shaped projection is pressed into the flat strip during the making of the cut in the cutting zone.

9. A method according to claim 1, wherein said projection is a supporting platform arranged on the cutting die, and said supporting platform is pressed into the flat strip during the making of the cut in the cutting zone.

10. A method according to claim 1, wherein the projection has one of either a V shape or a platform shape.

11. A method according to claim 1, wherein during said applying the position oriented compressive stress and the shearing at high compressive stress, the tool element cuts into the flat strip at a location positionally offset from the shearing punch to act with a controlled force in opposition to a squeezing of material by the cutting die, wherein the projection on the cutting die interacts with the tool element during said acting with the controlled force to guide resqueezing of the material in the cutting zone in a direction diagonal to the cutting line between the shearing punch and the cutting die.

12. A device for producing stampings out of a flat strip with an almost smooth and enlarged functional surface, comprising:

a tool having an upper part and a lower part, and comprising among the upper part and lower part at least a first shearing punch, a guide plate for the shearing punch, an ejector, another ejector, a cutting die, and a projection having one of either a V shape or a platform shape, said projection being arranged on the cutting die and being part of said lower part, wherein during operation, the flat strip is clamped between the guide plate and cutting die, and the projection is pressed into the flat strip; and at least one coaxial tool element comprising a second shearing punch distinct from the first shearing punch and positioned to have a movement retarded relative to movement of the first shearing punch, the at least one tool element applying a force on the flat strip so as to move into the flat strip in a cutting direction that shifts retardation material in a transversal direction to the cutting direction into a cutting zone, wherein a stamp side of the at least one tool element faces the projection, the at least one tool element being connected to a separate stud for controlling said force to be applied on the flat strip, the at least one tool element and the projection interacting on the flat strip from opposing directions for said shifting.

13. A device according to claim 12, wherein the stampings include fine blanking and/or forming a workpiece out of the flat strip.

14. A device according to claim 12, wherein the at least one tool element is movable in a vertical direction guided by the guide plate in cutting direction.

15. A device according to claim 12, wherein the at least one tool element includes a differential coining stamp.

16. A device according to claim 12, wherein said projection comprised in said tool and arranged on the cutting die is a supporting platform, said supporting platform limiting material flow into a breadth direction.

17. A device according to claim 12, wherein said projection comprised in said tool and arranged on the cutting die is a V-shaped projection, wherein said V-shaped projection is pressed into the flat strip, and wherein the stamp side of the at least one tool element is related to said V-shaped projection.

18. A device according to claim 12, wherein said projection comprised in said tool and arranged on the cutting die is a supporting platform, Wherein said supporting platform is pressed into the flat strip, and wherein the stamp side of the at least one tool element is related to said supporting platform.

19. A device according to claim 12, wherein the at least one coaxial tool element is connected to a separate stud than said upper part and lower part of said tool, said stud facilitating independent movement of the at least one tool element relative to a movement of the shearing punch, the at least one tool element configured to move into the flat strip at a position offset from a cutting line of said shearing punch, the tool element moving into the flat strip with a stamping force that at least deforms a surface of the flat strip, wherein said tool element and said projection are configured to interact on the flat strip from opposing directions during said at least one tool element moving into the flat strip so as to shift retardation material of the flat strip caused by the cutting movement of the shearing punch in a transversal direction to a stamping direction of the tool element into a stamping zone.

20. A fine blanking apparatus that adjusts a state of stress in a cutting zone during fine blanking and forming of a stamping out of a flat strip so as to achieve the stamping with an almost smooth and enlarged functional surface, the apparatus comprising:

a tool having an upper part and a lower part, and comprising among the upper part and lower part at least a shearing punch, a guide plate for the shearing punch, an ejector, another ejector, a cutting die, and a projection having one of either a V shape or a platform shape, said projection being arranged on the cutting die and being part of said lower part, wherein during operation, the flat strip is clamped between the guide plate and cutting die, and the projection is pressed into the flat strip; and at least one coaxial tool element, distinct from the shearing punch, acting on the flat strip in a same direction as the shearing punch and adjacent to an area of the flat strip acted on by the shearing punch, the at least one tool element being positioned to have a movement in a same direction as a direction of a cutting movement of the shearing punch while said tool element movement is retarded relative to said cutting movement of the shearing punch; and wherein the at least one tool element and the projection are positioned relative to each other to interact on the flat strip from opposing directions;

wherein the shearing punch is configured to cut along a cutting line in a cutting zone during a cutting operation into the flat strip;

wherein the cutting die is configured in opposition to said shearing punch to squeeze material during said cutting operation transverse to said cutting movement direction;

wherein the at least one tool element is configured to move into the flat strip and to apply a controlled force to the flat strip that, together with the projection as a barrier to transverse retardation of material, reduces conversion of compression stress to tensile stress in the flat strip as the shearing punch progresses along the cutting line into the flat strip, thereby reducing development of tears and rollover in the stamping so as to achieve said almost smooth functional surface of the stamping.

21. A device according to claim 20, wherein the at least one tool element is connected to a separate stud than the shearing punch for applying said controlled force.

22. A device according to claim 20, wherein said controlled force is predetermined according to a material type and a geometry of the flat strip.

23. A method for adjusting a state of stress in a cutting zone during fine blanking and forming of a stamping out of a flat strip so as to achieve the stamping with an almost smooth and enlarged functional surface, comprising:

clamping the flat strip at closing between an upper part and a lower part, the upper part including a shearing punch, a tool element that operates parallel to a cutting line of the shearing punch, a guide plate for the shearing punch, and an ejector, the lower part including a cutting die having a projection thereon, an ejector and an inner form stamp;

performing a cut in the cutting zone by first applying a position oriented compressive stress on the cutting zone between said upper and lower part with the tool element, then shearing through at a high compressive stress with the shearing punch and cutting die to complete the cut as part of said fine blanking;

during said shearing at high compressive stress the cutting die squeezing material; and during said applying the position oriented compressive stress, the tool element moving parallel to a direction of cutting of the shearing punch penetrating into the flat strip to apply a controlled force in opposition to the squeezing of material by the cutting die to resqueeze the material in the cutting zone in a direction diagonal to the cutting line between the shearing punch and the cutting die, said projection positioned relative to the tool element to support transverse flow of material during said resqueezing; and wherein said tool element is configured to operate in parallel relative to the shearing punch during said fine blanking to reduce conversion of compression stress to tensile stress during said cut, thereby reducing development of tears and rollover in the stamping so as to achieve said almost smooth functional surface of the stamping.

24. The method of claim 23, further comprising prior to said performing, performing a virtual forming simulation to identify parameters for configuring the tool element operation relative to said shearing press so that the tool element contributes to maintaining compressive stress during said performing the cut, and reduces conversion of compressive stress to tensile stress as the shearing by the shearing punch progresses along the cutting line.

25. The method of claim 23, wherein said applying position oriented compressive stress on the cutting zone is realized at parts having teeth or corner areas of medium to relatively greater thickness.

26. The method of claim 23, wherein both said fine blanking and said forming are accomplished together on said flat strip as said step of performing the cut resulting in the stamping having said almost smooth and enlarged functional surface.

* * * * *